US009701908B2

(12) United States Patent
Long et al.

(10) Patent No.: US 9,701,908 B2
(45) Date of Patent: Jul. 11, 2017

(54) BITUMEN DROPLETS COALESCENCE

(71) Applicant: SYNCRUDE CANADA LTD. in trust for the owners of the Syncrude Project as such owners exist now and in the future, Fort McMurray (CA)

(72) Inventors: Jun Long, Edmonton (CA); Shane Hoskins, Edmonton (CA)

(73) Assignee: SYNCRUDE CANADA LTD., Fort McMurray (CA), in trust for the owners of the Syncrude Project as such owners exist now and in the future ( * ) Notice: Subject to any disclaimer, the term of this patent is extended or adjusted under 35 U.S.C. 154(b) by 0 days.

(21) Appl. No.: 15/215,354

(22) Filed: Jul. 20, 2016

(65) Prior Publication Data

US 2017/0022421 A1 Jan. 26, 2017

Related U.S. Application Data

(60) Provisional application No. 62/196,185, filed on Jul. 23, 2015.

(51) Int. Cl.

| | |
|---|---|
| ***C10G 1/00*** | (2006.01) |
| ***C10G 1/04*** | (2006.01) |
| ***C10G 33/06*** | (2006.01) |

(52) U.S. Cl.

CPC ..... *C10G 1/00* (2013.01); *C10G 1/002* (2013.01); *C10G 1/047* (2013.01); *C10G 33/06* (2013.01)

(58) Field of Classification Search

CPC ..... C10G 1/00; C10G 1/047

See application file for complete search history.

(56) References Cited

U.S. PATENT DOCUMENTS

| | | | |
|---|---|---|---|
| 5,039,227 | A | 8/1991 | Leung et al. |
| 6,007,708 | A | 12/1999 | Allcock et al. |
| 2005/0082205 | A1 | 4/2005 | Bara et al. |

FOREIGN PATENT DOCUMENTS

| | | | |
|---|---|---|---|
| CA | 2029795 | A1 | 11/1989 |
| CA | 2217623 | A1 | 10/1997 |

OTHER PUBLICATIONS

Masliyah, J. et al. "Understanding Water-Based Bitumen Extraction from Athabasca Oil Sands". Can. J. Chem. Eng. vol. 82(4), pp. 628-654, 2004.

*Primary Examiner* — Randy Boyer

(74) *Attorney, Agent, or Firm* — Bennett Jones LLP

(57) ABSTRACT

A process is provided for treating an aqueous oil sand slurry containing bitumen droplets and air bubbles prior to separation in a separator, comprising separating the aqueous oil sand slurry into at least two individual slurry streams and allowing the at least two slurry streams to collide with one another such that the bitumen droplets and air bubbles in each slurry stream make contact with one another to increase both collision frequency and efficiency, and providing sufficient residence time to allow the bitumen droplet to coalesce, grow, and aerate to produce a treated oil sand slurry with larger and lighter bitumen droplets to improve bitumen flotation and recovery.

7 Claims, 1 Drawing Sheet

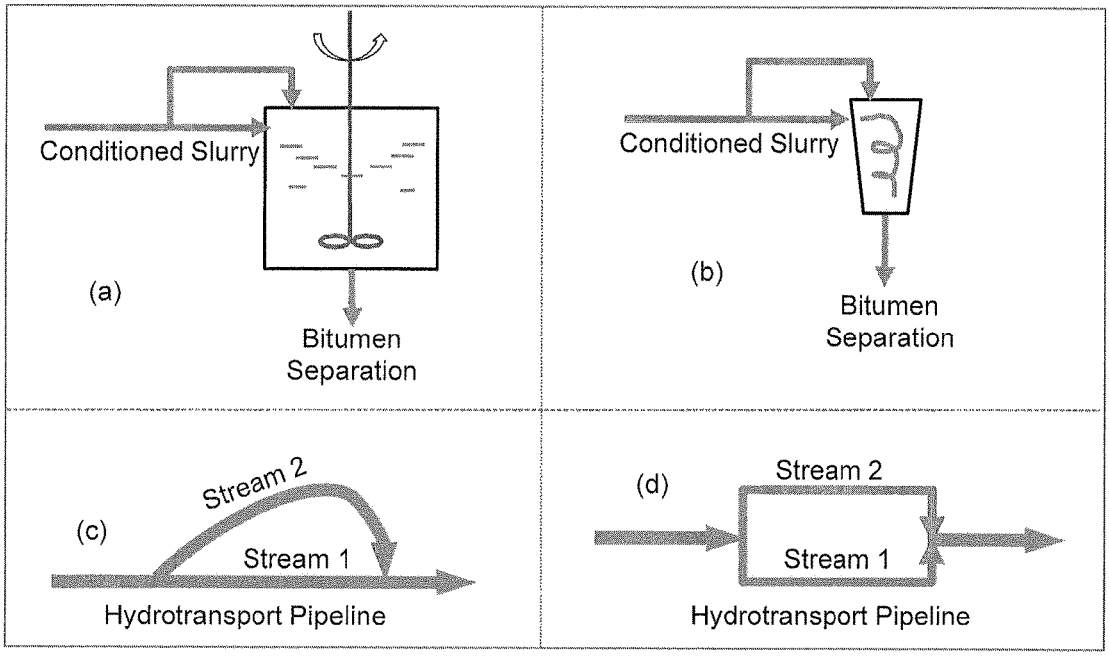
Conditioned Slurry
(a)
Bitumen
Separation
Conditioned Slurry
(b)
Bitumen
Separation
Stream 2
(c)
Stream 1
Hydrotransport Pipeline
(d)
Stream 2
Stream 1
Hydrotransport Pipeline

BITUMEN DROPLETS COALESCENCE

FIELD OF THE INVENTION

The present invention relates generally to water-based extraction of bitumen from oil sand and, more particularly, to a process for treating an aqueous oil sand slurry to enhance the coalescence and aeration of bitumen droplets through increasing the collision frequency and efficiency between bitumen droplets and between bitumen droplets and air bubbles.

BACKGROUND OF THE INVENTION

The oil sands in Northern Alberta constitute one of the largest hydrocarbon reserves in the world. Oil sands are a combination of bitumen, quartz sand, clay, water and trace minerals. Bitumen can be recovered from oil sands using two main methods: open-pit mining and in situ drilling. Approximately 20% of the oil sands lie close enough to the earth's surface to be mined.

The key characteristic of Alberta oil sand that makes bitumen economically recoverable is that the sand is hydrophilic and encapsulated by a water film. The presence of this water film prevents the direct contact of bitumen and sand. Thus, by slurrying mined oil sand with water, the bitumen is allowed to liberate from the sand grains and move to the aqueous phase. In a water-based bitumen extraction process, the efficiency of bitumen separation is determined by the following four fundamental steps: bitumen liberation, bitumen droplets coalescence, bitumen droplets aeration, and bitumen flotation.

There is a strong correlation between bitumen droplet size and bitumen recovery. In general, good bitumen flotation in a primary separation vessel or PSV and, hence, good bitumen recovery, can be obtained if the average size of bitumen droplets is greater than 400 μm. On the other hand, the recovery can be very poor if the average size of bitumen droplets is smaller than 200 μm. For small bitumen droplets (e.g., ≤200 μm), bitumen flotation can be challenging. In addition, the density difference between bitumen and water is very small under normal extraction conditions. Bitumen droplets must be aerated to become lighter than water so that they are able to float to the top of a separation vessel to be recovered. Both bitumen droplets coalescence and aeration are critical for bitumen extraction.

It is generally believed that when a bitumen droplet is very small, its probability of collision with another droplet for coalescence and with a bubble (e.g., air bubble) for aeration is very low, This is because a small droplet does not possess sufficient kinetic energy to deviate from the streamlines and to displace the intervening liquid layer to collide with other bitumen droplets and/or bubbles. In addition, the interaction forces between bitumen droplets and between bitumen droplets and bubbles are naturally repulsive due to the operation conditions normally used (e.g., slurry pH in the range of 7.5 to 9.5). The presence of strong repulsive forces makes coalescence and aeration difficult. Small bitumen droplets are also difficult to rise to the top of a separation vessel to be recovered.

Several different water-based bitumen extraction processes have been developed throughout the years. One such extraction process is commonly referred to in the industry as the "hot water process". In general terms, the hot water process involves feeding the mined oil sand into a rotating tumbler where it is mixed for a prescribed retention time (generally in the range of 2 to 4 minutes) with hot water (approximately 80-90° C.), steam, caustic (e.g., sodium hydroxide) and naturally entrained air to yield a slurry that has a temperature typically around 80° C. The bitumen matrix is heated and becomes less viscous. Chunks of oil sand are ablated or disintegrated. The released sand grains and separated bitumen flecks are dispersed in the water. To some extent bitumen flecks coalesce and grow in size. They may contact air bubbles and coat them to become aerated bitumen. The term used to describe this overall process is "conditioning". The conditioned oil sand slurry is then subjected to gravity separation, generally in a PSV, to produce a bitumen froth product.

More recently, a number of bitumen extraction processes have been developed which rely on conditioning of the oil sand slurry in a hydrotransport pipeline. Pipeline conditioning or hydrotransport is disclosed in Canadian Patent No. 2,029,795 and U.S. Pat. No. 5,039,227. In one such extraction processes, heated water (typically at 95° C.) is mixed with the dry as-mined oil sand at the mine site in predetermined portions using a device known as a "cyclofeeder", to form an aerated slurry having a temperature in the range of 40-70° C., preferably about 50° C. The slurry is then pumped to the extraction plant through several kilometres of pipeline, where conditioning (i.e., lump digestion, bitumen liberation, bitumen droplet coalescence and bitumen droplet aeration) occurs. The conditioned oil sand slurry is then subjected to gravity separation, generally in a PSV, to produce a bitumen froth product.

A low energy extraction process for extracting bitumen from oil sand is disclosed in Canadian Patent No. 2,217,623 and U.S. Pat. No. 6,007,708. This process involves mixing the mined oil sand with water in predetermined proportions in a mix box located near the mine site to produce a slurry containing entrained air and having a controlled density in the range of 1.4 to 1.65 g/cc and preferably a temperature in the range 20-40° C. The slurry is then pumped through a pipeline to condition the slurry. Once again, the conditioned oil sand slurry is subjected to gravity separation, generally in a PSV, to produce a bitumen froth product.

For good processing ores, the bitumen droplets generated during conditioning of oil sand slurry are normally big enough to obtain desirable bitumen recovery. However, for problem ores (e.g., low-grade high-fines ores), the average size of the bitumen droplets generated are often small, leading to poor extraction performance. In order to improve the overall performance of a water-based bitumen extraction process, especially for problem ores, the efficiency of bitumen droplets coalescence and aeration needs to be improved to increase the average size of bitumen droplets.

In many existing water-based bitumen extraction processes, caustic (e.g., sodium hydroxide) is used as a process aid to improve the overall performance. Caustic helps to release natural surfactants and affects surface properties of bitumen, sand, and clays. The use of caustic reduces the attachment of fine solid particles on bitumen surface (so called slime coating), thus facilitating the coalescence and aeration of bitumen droplets. However, the use of caustic increases the slurry pH and thus increases the repulsions between bitumen droplets and between bitumen droplets and bubbles. The use of a conditioning step in existing extraction processes with mechanical energy input also helps the coalescence and aeration of bitumen droplets, improving the overall performance.

However, when processing problem ores, the use of caustic and the existing conditioning step often does not provide enough improvement to bitumen droplet coalescence and aeration to obtain desirable performance. In a hydrotransport pipeline, bitumen droplets and bubbles travel in the same direction. As a result, small bitumen droplets may not possess sufficient kinetic energy to deviate from the streamlines and to displace the intervening liquid layer to collide with other bitumen droplets and/or bubbles. Also, as the bitumen droplets and bubbles essentially travel in parallel, the probability for them to collide to each other is low. Thus, it is believed that the efficiency of bitumen droplets coalescence and aeration in such a pipeline may be limited.

Therefore, there is a need in the industry to improve the efficiency of bitumen droplets coalescence and aeration during oil sand extraction, especially for poor processing ore.

SUMMARY OF THE INVENTION

The current application is directed to a process for treating an aqueous oil sand slurry to enhance the coalescence and aeration of bitumen droplets through increasing the collision frequency and efficiency between bitumen droplets and between bitumen droplets and bubbles. Small non-aerated bitumen droplets may coalesce and grow to a size that may more readily aerate. With larger and lighter bitumen droplets, bitumen flotation in a separation vessel can be improved, thus enhancing the overall extraction performance.

In accordance with one aspect of the invention, a process is provided for treating an aqueous oil sand slurry containing bitumen droplets and air bubbles prior to separation in a separator, comprising:

- separating the aqueous oil sand slurry into at least two individual slurry streams;
- allowing the at least two slurry streams to collide with one another such that the bitumen droplets and air bubbles in each slurry stream make contact with one another to increase both collision frequency and efficiency; and
- providing a residence time to allow the bitumen droplets to coalesce, grow, and aerate to produce a treated oil sand slurry with larger and lighter bitumen droplets to enhance bitumen flotation and recovery.

In one embodiment, the process further comprises introducing the treated oil sand slurry into a separation zone for forming a bitumen froth.

In one embodiment, the at least two slurry streams collide in a mixing vessel with a residence time of at least 2 to 5 minutes. In another embodiment, the at least two slurry streams collide in a pipeline. In one embodiment, the aqueous oil sand slurry has been previously conditioned in a pipeline. In another embodiment, the oil sand slurry has been previously conditioned in a tumbler.

By "conditioning" is meant digestion of oil sand lumps, liberation of bitumen from sand-fines-bitumen matrix, coalescence of liberated bitumen flecks into larger bitumen droplets and aeration of bitumen droplets. The conditioning step can be performed either by pumping the oil sand slurry through a pipeline of sufficient length (e.g., typically greater than about 2.5 km), or by agitating the oil sand slurry in a tumbler or agitation tank for a sufficient period of time, so that liberation of bitumen from sand and subsequent aeration of bitumen both have time to occur. Preferably, conditioning time is about 2 to about 12 minutes when using a tumbler and 10 minutes or more when using a pipeline of sufficient length.

BRIEF DESCRIPTION OF THE DRAWINGS

FIG. 1 illustrates four different embodiments of the present invention in panels (a) to (d).

DESCRIPTION OF THE PREFERRED EMBODIMENT

The invention is exemplified by the following description and examples.

The present invention is directed to the coalescence and aeration of bitumen droplets. In order for bitumen droplets to coalesce, two key steps must occur: (1) the droplets must collide, and (2) once they have collided the interfacial forces must be of the nature to promote the coalescence of the two droplets. Without being bound by theory, it is believed that droplet coalescence frequency ($\Gamma$) is the product of the collision efficiency ($\lambda_c$) and the collision frequency ($\xi_c$). The collision frequency is the number of encounters between droplets per unit time per unit volume.

Thus, in accordance with the present invention, any factor that increases the collision frequency is likely to increase droplets coalescence. In a conventional hydrotransport pipeline, the bitumen droplets and air bubbles essentially travel in the same direction or in parallel. Thus, the probability for these droplets and bubbles to collide with one another is low. The efficiency of bitumen droplets coalescence and aeration in such a pipeline is consequently limited.

It was discovered that one way to improve the efficiency of bitumen droplets coalescence and aeration is to create at least two streams of oil sand slurry (generally from a single stream) and remix these streams in such a way to increase bitumen-bitumen and bitumen-bubble collision frequency/efficiency and/or local droplet/bubble concentration to enhance bitumen droplets coalescence and aeration. In one embodiment, two streams of oil sand slurry can travel in opposite directions, thereby allowing the two streams to collide with one another. In another embodiment, two oil sand slurry streams may travel across each other (e.g., collide perpendicularly to one another).

When the at least two streams meet each other, the droplets and bubbles in one stream will collide with those in the other stream. Thus, the bitumen droplets do not need to deviate from the streamlines and displace the intervening liquid layer in order to collide with other droplets/bubbles, as would be required in the case of where there is only one oil sand slurry stream in which droplets and bubbles travel in parallel. As a result of multiple streams of oil sand slurry colliding with one another, the efficiency of bitumen droplets coalescence and aeration will be improved.

FIG. 1 consists of four panels (a) to (d), where each panel illustrates an embodiment of the present invention for creating two oil sand slurry streams to enhance bitumen droplets coalescence and aeration. In the three embodiments shown in panel (a), panel (b), and panel (c), the two streams meet at a point where the droplets/bubbles in one stream will collide with those from the other stream travelling in a perpendicular direction. Panel (d), is an embodiment where two streams travel in opposite directions.

Tests were performed using the embodiment shown in panel (a) of FIG. 1. More particularly, a stream of conditioned oil sand slurry was separated into two streams and the two streams were allowed to collide with one another perpendicularly in a stirred mixer with a residence time of at least 2 to 5 minutes to produce treated oil sand slurry of the present invention. The treated oil sand slurry was then subjected to bitumen separation in a separation vessel. The resulting bitumen recovery increased by 20% as compared to bitumen froth obtained from untreated oil sand slurry (i.e., from the single stream of conditioned oil sand slurry).

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are known or later come to be known to those of ordinary skill in the art are intended to be encompassed by the elements of the claims. Moreover, nothing disclosed herein is intended to be dedicated to the public regardless of whether such disclosure is explicitly recited in the claims.

We claim:

1. A process for treating an aqueous oil sand slurry containing bitumen droplets and air bubbles prior to separation in a separator, comprising:

(a) separating the aqueous oil sand slurry into at least two individual slurry streams;

(b) allowing the at least two slurry streams to collide with one another such that the bitumen droplets and air bubbles in each slurry stream make contact with one another to increase both collision frequency and efficiency; and (c) providing a residence time to allow the bitumen droplets to coalesce, grow, and aerate to produce a treated oil sand slurry with larger and lighter bitumen droplets to enhance bitumen flotation and recovery.

2. The process as claimed in claim 1, further comprising introducing the treated oil sand slurry into a separation zone for forming a bitumen froth.

3. The process as claimed in claim 1, wherein the at least two slurry streams collide in a mixing vessel.

4. The process as claimed in claim 3, wherein the residence time in the mixing vessel is in a range of about 2 minutes to about 5 minutes.

5. The process as claimed in claim 1, wherein the at least two slurry streams collide in a pipeline.

6. The process as claimed in claim 1, wherein the aqueous oil sand slurry has been previously conditioned in a pipeline.

7. The process as claimed in claim 1, wherein the aqueous oil sand slurry has been previously conditioned in a tumbler.

* * * * *